United States Patent [19]

Stinson

[11] Patent Number: 4,704,800

[45] Date of Patent: Nov. 10, 1987

[54] BOW SIGHT-MOUNTING AND ACCESSORY-MOUNTING APPARATUS

[76] Inventor: Robert E. Stinson, 7292 Peaceful Valley Rd., Acme, Mich. 49610

[21] Appl. No.: 853,678

[22] Filed: Apr. 18, 1986

[51] Int. Cl.[4] ..... F41G 1/46; F41B 5/06

[52] U.S. Cl. ..... 33/265; 124/23 A; 124/88

[58] Field of Search ..... 33/265; 124/23 A, 86, 124/87, 88, 89

[56] References Cited

U.S. PATENT DOCUMENTS

| | | | |
|---|---|---|---|
| 2,817,919 | 12/1957 | Cress | 124/88 |
| 4,156,496 | 5/1979 | Stinson | 124/23 A |
| 4,317,288 | 3/1982 | Yasui | 33/265 |
| 4,332,231 | 6/1982 | Napier et al. | 124/88 |
| 4,363,312 | 12/1982 | Spitzke | 124/88 |
| 4,377,152 | 3/1983 | Saunders | 124/23 A |
| 4,535,747 | 8/1985 | Kudlacek | 33/265 |
| 4,553,338 | 11/1985 | LeBeau | 33/265 |

OTHER PUBLICATIONS

"Typhoon XT", *Bow & Arrow,* Oct. 1983, p. 7.

*Primary Examiner*—Richard R. Stearns

*Attorney, Agent, or Firm*—Price, Heneveld, Cooper, DeWitt & Litton

[57] ABSTRACT

A multi-purpose archery accessory-mounting device is disclosed, having a main support base which mounts on the bow by use of standardized mounting means customarily provided on the bow handle, and including an adjustable mounting member which projects forwardly of the bow handle and which incorporates the standardized mounting aperture array which corresponds to the standardized array of mounting screws utilized on standard "flat-type" bow sights. The apparatus further includes a cable guard projecting in a direction opposite that of the bow sight-mounting member, to overlie the cable on a compound bow. Additionally, the apparatus incorporates an integral mount for detachably receiving an arrow quiver of the "bow-mount" type, in a position alongside the bow handle but closer to the archer than the position of the bow sight. The apparatus thus provides for interchangeable and adjustable mounting of standard "flat-type" bow sights, as well as providing for use of a bow-mount-type arrow quiver and a cable guard, in mutually-independent and selectable manner while at the same time possessing the capability of constituting an integrated, unitary apparatus.

14 Claims, 12 Drawing Figures

BOW SIGHT-MOUNTING AND ACCESSORY-MOUNTING APPARATUS

This application discloses and claims functional apparatus whose ornamental design is the subject of Applicant's co-pending application for design Pat. Ser. No. D728,106.

FIELD OF THE INVENTION

This invention relates generally to archery apparatus, and more particularly to means for mounting accessory apparatus upon archery bows, especially compound bows. Still more particularly, the invention relates to a novel apparatus to be mounted upon an archery bow which incorporates multiple and variable adjustable and interchangeable mounting elements for carrying accessory devices such as bow sights, bow-fishing reels, cable guards, quivers, and the like, in an adjustable and readily-demountable manner to permit rapid and easy removal and interchange of such devices.

BACKGROUND

Generally speaking, archery bow manufacturers do not incorporate built-in (permanently-attached) accessory devices such as bow sights, quivers, etc., since there is a wide variety of such devices available in the after-market and archers have an equally wide variety of different preferences, likes, and dislikes for specific different accessory types and styles. Consequently, bow manufacturers usually go no further than providing a mounting pad (essentially, a pattern of tapped mounting holes located in a particular location and position on the bow) which is basically of a standardized configuration, and it is left to the individual archer to obtain and suitably mount his own preference in accessory devices. For the most part, accessory manufacturers are not the same companies as those which manufacture archery bows, and there are understandably a much larger number of accessory manufacturers than there are bow manufacturers. Nonetheless, a certain amount of standardization has become established in the mounting means for the different bow accessories, at least with respect to bow sights, which typically are manufactured with a mounting flange or bracket having at least one flat side to rest flush against the mounting pad provided by the bow manufacturer, and with an array of mounting apertures disposed in the same positions as the tapped holes provided by the bow manufacturer.

Accordingly, the typical procedure for the consumer who has purchased a new archery bow is to select his preferred bow sight and attach it to the bow himself, in a semi-permanent manner, usually with mounting screws which are firmly tightened to assure a secure attachment of the apparatus. Thus, in order to remove or change the bow sight, the archer typically returns to his workbench, since tools are required and the task necessitates at least a moderate expenditure of time. This obviously precludes any rapid changing of the bow sight in the field, as might for example be desired while hunting, when the hunter moves to a tree mount or other elevated position, in which the hunter normally prefers a different type of sight. Also, the semi-permanently, or quasi-permanently affixed sight is cumbersome and poses a problem when carrying the bow in a case, since the cases are not usually adapted to fit the combined bow and sight.

A further limitation and undesirable feature typically found in archery is the absence of a convenient and adaptive mounting means for other accessory devices such as bow-mounted quivers, fishing reels (as used in bow fishing), cable guards, and the like. Very often, "homemade" mounting arrangements are utilized, in which the archer himself, or a selected artisan, must actually drill new holes into the bow and make other such permanent changes in the bow, for securing screws, fasteners, etc., to the bow. Obviously, such changes are not reversible in nature and tend to disfigure the bow, as well as perhaps weakening it; in addition, such an approach does not lend itself to modification or adaptation in the event other and different accessory devices are desired to be mounted upon the bow in the future.

SUMMARY OF THE INVENTION

Briefly stated, the present invention provides novel and useful accessory-mounting means for archery bows, including a base member which is especially adapted for mounting to the bow on the aforementioned mounting pad provided by the manufacturer for both sights, and further including at least one movable and preferably demountable and interchangeable mounting element which is movably and adjustably received by the base member, together with means for releasably securing the mounting member upon the base. The mounting member is particularly configured to receive and carry any desired bow sight having a standardized mounting aperture configuration, and is adapted for rapid and easy adjustment of the position of such bow sight, as well as adapted for easy and rapid interchangeability of bow sights merely by quickly removing and interchanging one such mounting member with another, each mounting member carrying a different type of bow sight.

Additionally, in accordance with the invention, other archery accessories may be secured to and carried by the adjustable and removable mounting members, and the invention provides alternate forms of mounting members adapted for use with different general types of accessories, wherein each such mounting member has the same type of attachment means which is cooperatively receivable by the base member, such that any or all such accessories may readily be interchanged with one another by rapidly interchanging the mounting members on which they are carried.

Further, in accordance with the invention, the aforementioned base member is preferably adapted to carry a bow-mounted arrow quiver, and is particularly designed to locate and position such quiver in a centralized and balanced position, generally in the plane of the bowstring and approximately equidistant from the tips of the bow, in which position the quiver, and any arrows carried thereby, may in fact function in the manner of a vibration-balancing and dampening apparatus, while at the same time carrying desired extra arrows in the most convenient and most easily-carried position.

Additionally, in accordance with the invention, a cable-guard arm is incorporated in the novel apparatus, preferably carried upon the base member, and such cable-guard arm may be made to be removable from the base if and when desired, as for example may be the case where the bow manufacturer provides a built-in cable-guard apparatus, as at least a small number of bow manufacturers do.

Accordingly, it will be seen that in accordance with the invention a novel and desirable device is provided for combined mounting of selected archery bow accessory devices, without requiring modification or alteration of the bow itself and while using only the original and standard mounting pad provided by the manufacturer, while at the same time providing for desired adjustability, removability, and interchangeability of the different accessory devices, as may be desired at any particular time by the archer.

The advantages provided and objectives satisfied by the aforementioned improvements will become more apparent and better understood by reference to the ensuing specification, which describes certain preferred embodiments to illustrate the underlying concept, together with reference to the appended drawings depicting the particularities of such preferred embodiments.

DESCRIPTION OF PREFERRED EMBODIMENTS

Figure 1:
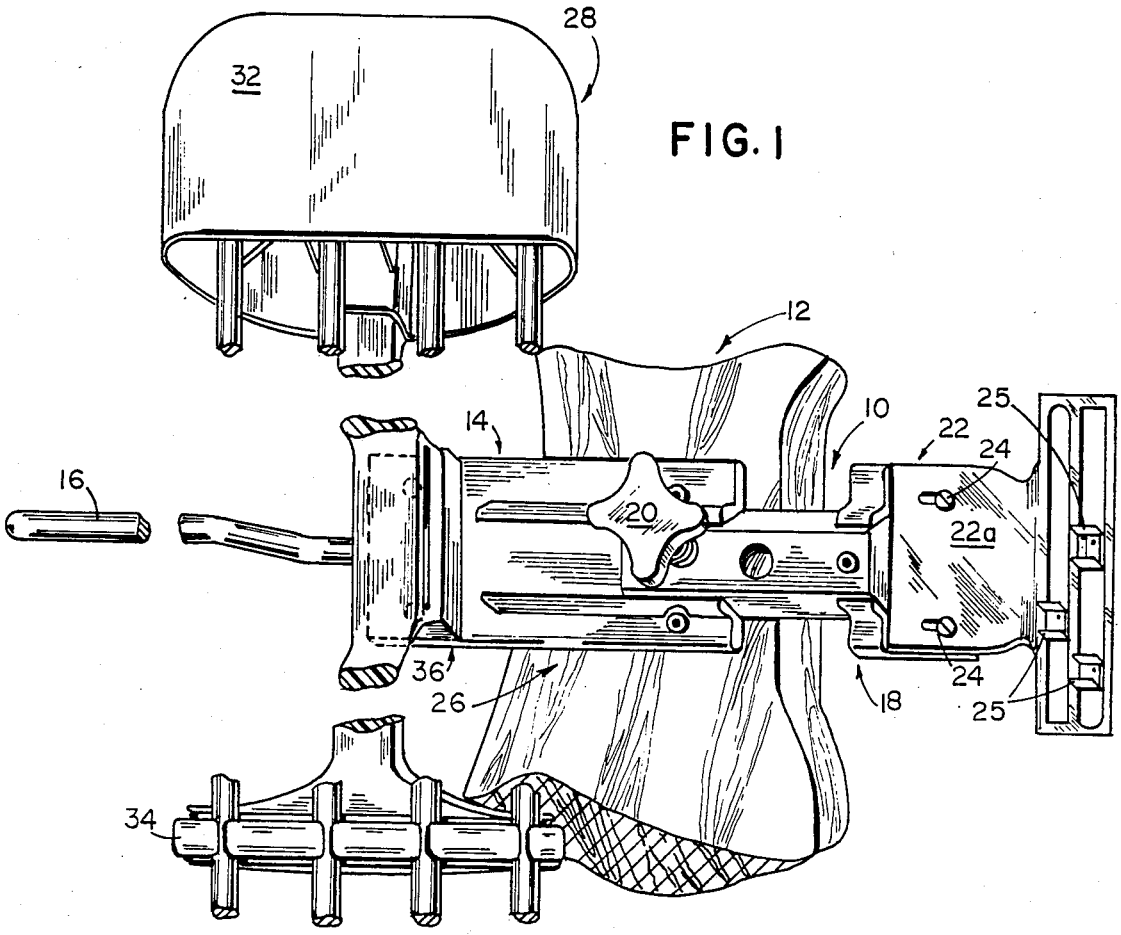
FIG. 1 is a fragmentary perspective view showing the apparatus as mounted on an archery bow and carrying a typical bow sight as well as an arrow quiver, which is shown in a pictorial, representative sense.

Referring now in more detail to the drawings, the mounting apparatus 10 of the invention, shown attached to an archery bow 12 in FIGS. 1–4 and 11, comprises a base portion 14 which carries an elongated cable-guard arm 16 and an adjustably movable, and removable, mounting member 18 whose position is secured by an adjustment knob 20. Mounting member 18 is particularly adapted to carry a conventional bow sight 22 (FIG. 1), which may be of a number of different specific configurations but which is typically characterized by a mounting bracket **22*a* having a pair of particularly-located, mutually-spaced mounting apertures for receiving a pair of mounting screws 24, which are intended to be used to mount the bow sight directly upon the bow 12, upon a mounting pad or area (generally designated by the arrow 26**) provided for the manufacturer of the bow at an essentially standardized position along the grip thereof.

As already noted hereinabove, archery bow sights come in a wide variety of types and styles, but most present-day sights do incorporate a mounting flange or bracket such as that indicated at **22*a*, with the particularly-positioned mounting apertures for the screws 24. The bow sight 22 shown in FIG. 1 is of a general type frequently encountered in actual use, incorporating a plurality of sighting and/or range-finding pegs or posts 25**.

As will be understood, the bow sight per se, and its particular features, form no part of the present invention, apart from the mounting and positioning afforded by the present accessory-mounting and positioning apparatus, and is a part of the new combination provided and made possible by the latter. This is also basically true with respect to the arrow quiver 28, although for a better understanding of the apparatus shown in FIG. 1, and perhaps of the overall invention, it may be pointed out that the arrow quiver 28 includes generally a main body portion 30 supporting at one end a broadhead shield 32 of a dished or cup-like configuration, and an arrow shaft holder and separator member 34, which is a resilient member having a series of notches to receive a grip the shafts of the arrows. As generally indicated in FIG. 1, the quiver 28 is preferably of a type which is removably mountable by its own mounting bracket 36. A particular example of a preferred such arrow quiver is shown in U.S. Pat. No. 4,156,496, which is incorporated herein by reference, the inventorship of which is also by the present inventor.

Figure 11:
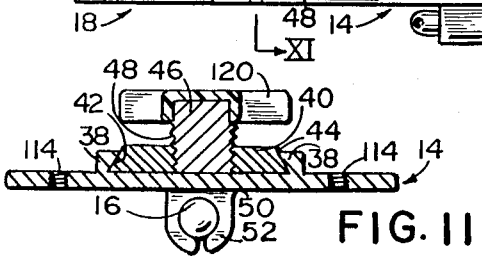
FIG. 11 is an enlarged, transverse sectional elevation taken along the plane XI—XI of FIG. 8.
Figure 9:
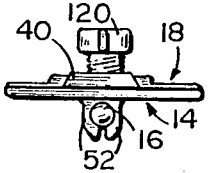
FIG. 9 is an end elevation of the apparatus as shown in FIGS. 5 and 6, as seen from the left.
Figure 10:
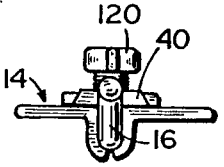
FIG. 10 is an end elevation of the apparatus as shown in FIGS. 5 and 6, as seen from the right.

Referring more particularly to FIGS. 5–11 inclusive, in which structural details of the mounting apparatus 10 are best seen, it will be seen that the base member 14 carries a pair of spaced, upstanding guide rails 38, which slidably receive a projecting support member 40 which is attached to and/or part of the accessory-mounting member 18. Preferably, the guide rails 38 and the support member, or slide, 40 have angular faces 42 and 44, respectively (FIG. 10) which form and define a slidable dovetail joint. The adjustment knob 20 (and its alternate form 120 shown in FIG. 5) are secured to the top of an adjustment stud 46 (FIG. 10) which is threaded along its length and threadably received in one of two (or more) threaded apertures 48 extending through the support member, or slide, 40. As best illustrated in FIG. 11, the base 14 preferably carries a circular recess 50 sized to receive the innermost end of the adjustment stud 46 when the same is threaded into the slide 40 an extent sufficient to protrude slightly beyond the underside of the member 40, such that by tightening the adjustment stud in place in this position, the mounting member 18 is in effect locked in place upon the base 14. In order to provide a series of different such locked positions, a plurality of the threaded apertures 48 may be provided and, if desired, a plurality of the circular recesses 50 may also be provided along the top surface of base 14 between the two guide rails 38.

The cable-guard arm 16 is an elongated and preferably angularly-offset rod-like member which extends rearwardly (toward the archer) with respect to the handle and limbs of the bows, overlying the cable of a compound bow (or bowstring of an ordinary recurve or other such "long bow", where the apparatus of the invention is used in that environment). In this position, the cable guard 16 in effect serves as a protector between the archer and the cable, or bowstring, in a generally known manner. In accordance with the invention, the cable-guard arm 16 is preferably retained in place on the underside of the base 14 by a pair of upstanding and mutually-spaced retaining arms 52 (52*a*, 52*b*) (best seen in FIGS. 6, 9, 10 and 11). This attachment of the cable-guard arm 16 may be made semipermanent in nature where the retaining arms 52 are either at least slightly resilient or slightly distensible in nature, such as to permit spreading the two arms apart and removing the cable-guard arm. Such a procedure is desirable, for example, in instances where the bow manufacturer incorporates a "built-in" cable guard, and/or in instances where the archer prefers to mount an additional accessory on or in conjunction with a rearwardly-extending arm of the general nature shown as the cable-guard arm herein.

In a particular preferred construction of the apparatus in accordance with the invention, the base 14 and mounting member 18 comprise extruded or molded sections, with integral guide rails 38 and mounting brackets 52. In a particular example of such a structure, the mounting bracket 14 may be extruded aluminum, which affords desirable strength and rigidity with attendant lack of mass. The mounting member 18 may be a molded element formed from a strong polymeric material if desired (e.g., hard nylon, glass-filed polycarbonate, etc.); alternatively, the mounting member 18 may also be extruded aluminum, with the forward mounting area 18*a* machined in place. In this form, the mounting member may include a pair of upraised retaining members 54 (FIG. 5) generally similar in configuration to the aforementioned guide rails 38 of base 14, such that the support member or slide 40 may comprise an extruded aluminum bar-like element having integrally-formed angular faces 42, 44 which fit between the angularly-disposed elements 54 just noted. In this configuration, it is desirable to securely attach the slide member 40 to the mounting member 18, as by a screw 56 extending therebetween. Similarly, the cable-guard arm 16 may be additionally retained in place between the two mounting brackets 52 by a flat-headed machine screw 58 FIGS. 5 and 7. As will be understood, such specific details of construction are subject to considerable change and variation, depending upon particular objectives to be attained, or upon availability of parts, economics, etc., such variations all being within the scope of the invention.

As noted previously, the forward portion 18*a* of the mounting member 18 is especially configured to replicate the typical "flat-type" bow sight mount, as exemplified by the mounting flange 22*a* illustrated in FIG. 1. Accordingly, mounting member 18 incorporates a pair of spaced apertures 124 (FIGS. 5 and 6), which are identically spaced and configured with the corresponding apertures in the bow sight mounting flange 22*a*, i.e., to receive the mounting screws 24, apertures 124 preferably being threaded to receive the screws 24 and thereby mount the sight upon the mounting member 18. In a generally similar manner, the forward portion of the base 14 carries a pair of mounting apertures 114 (FIGS. 5 and 6), which also replicate the typical "flat-type" bow sight mount, whereby the base 14 may be secured in place upon the bow 12 on the bow sight-mounting pad 26 provided by the bow manufacturer, to thereby mount the entire accessory-mounting apparatus 10 upon the bow without any modification thereof. Additionally, the rearwardmost portion of the base 14 carries an additional such pair of mounting apertures 214. These apertures are provided in order to mount additional accessories upon the base 14, e.g., an arrow quiver such as that generally indicated at 28 in FIGS. 1 and 2, or other types of archery accessory, as may be desired.

Figure 2:
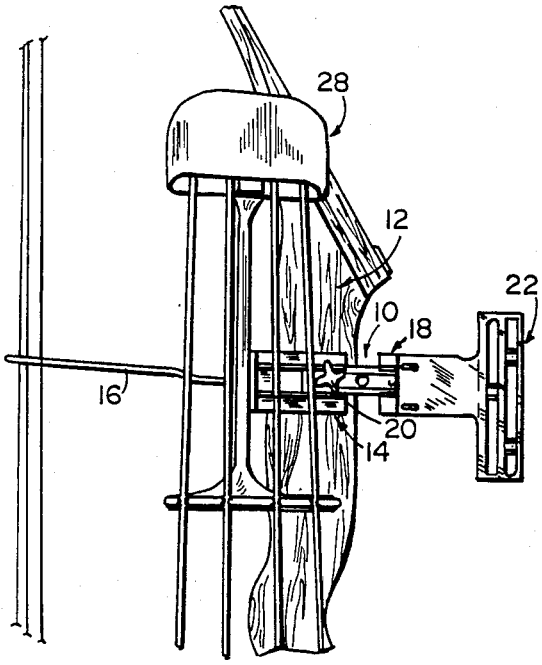
FIG. 2 is a fragmentary plan view generally similar to FIG. 1 but showing other particularities.
Figure 3:
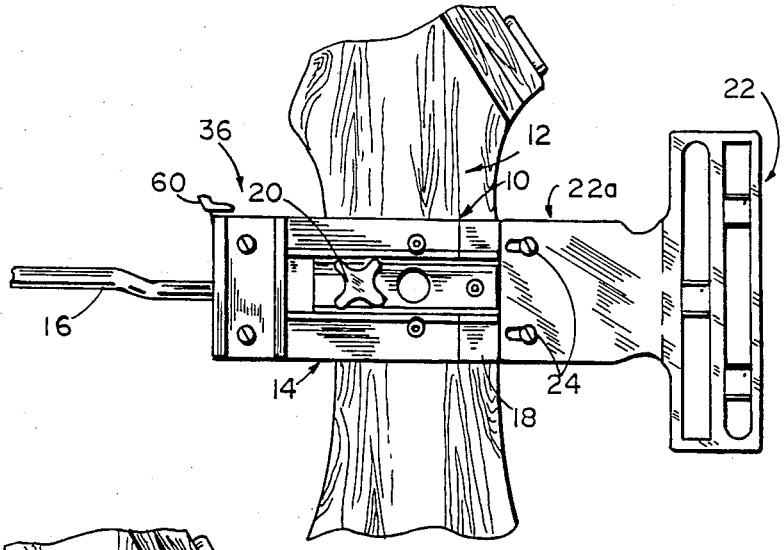
FIG. 3 is a fragmentary plan view similar to FIGS. 1 and 2 but showing other features.
Figure 4:
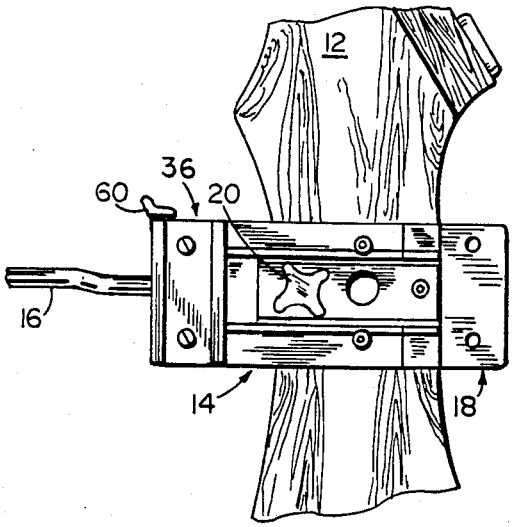
FIG. 4 is a fragmentary plan view similar to FIGS. 1 and 2 but showing other features.
Figure 5:
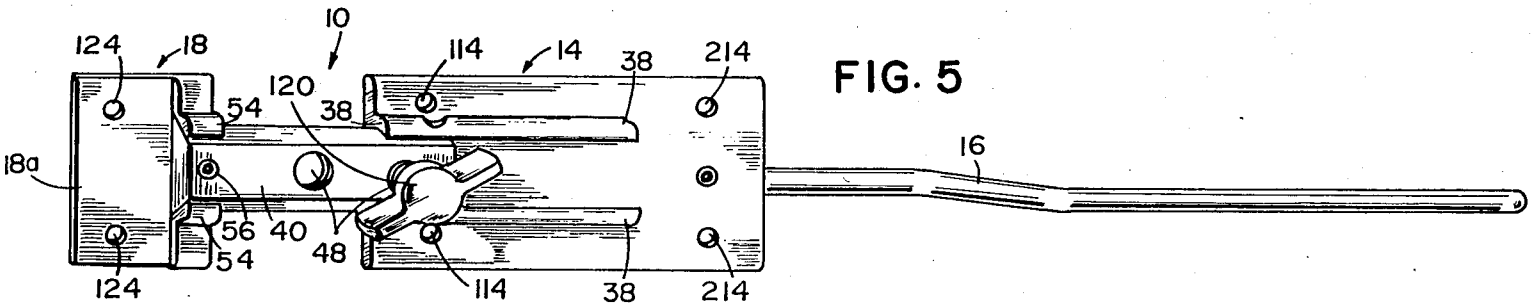
FIG. 5 is a top perspective of the mounting apparatus shown apart from the bow.
Figure 6:
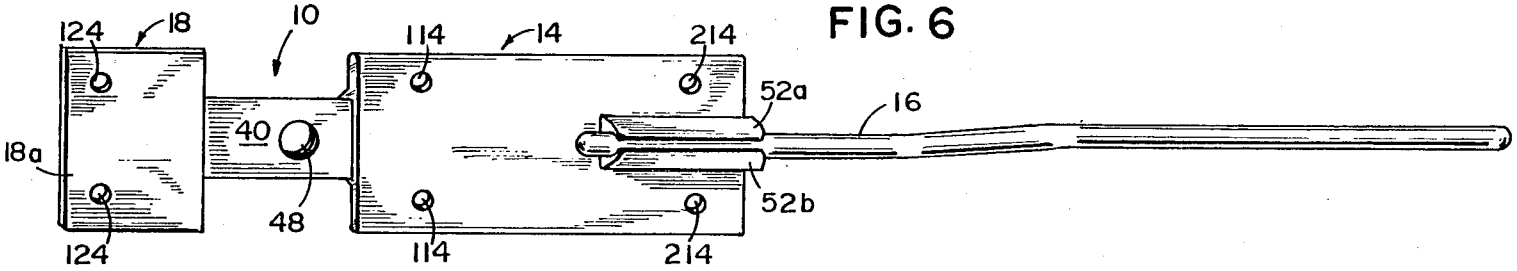
FIG. 6 is a bottom perspective view of the apparatus shown in FIG. 5.
Figure 7:
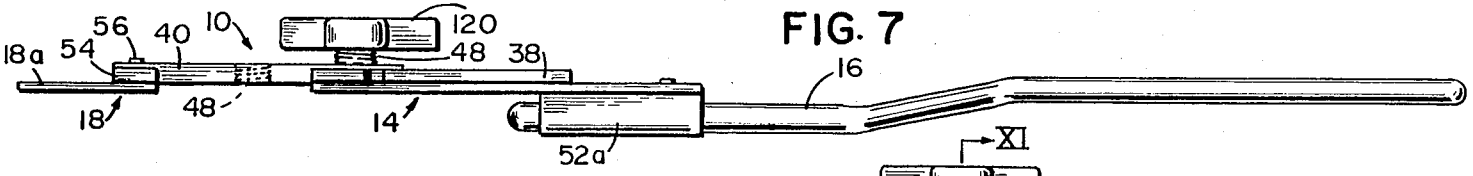
FIG. 7 is a side elevational view of the apparatus as shown in FIGS. 5 and 6.
Figure 8:
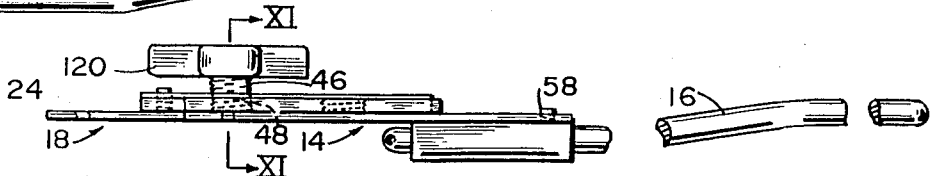
FIG. 8 is a fragmentary side elevational view similar to FIG. 7, but showing changes in the relative positioning of certain of the components.

Referring more particularly to the additional archery accessory-mounting capability provided by the rearward set of mounting apertures 214 (which may be termed the "secondary" accessory-mounting means, the forward portion 18*a* of mounting member 18, with its apertures 124 being the "primary" accessory-mounting means), while many conventional "bow-mount" quivers are known and available which could very well be mounted upon the rearward portion of the base member 14, it is to be pointed out that a preferred such arrangement is that illustrated in FIGS. 2, 3 and 4, which as noted above is preferably the type of apparatus set forth in my prior U.S. Pat. No. 4,156,496. Somewhat more particularly, this type of quiver includes a mounting apparatus having a quick-release quiver-mounting bracket, depicted in FIGS. 3 and 4 and designated by the numeral 36 therein. Such a bracket includes outwardly-projecting screws or the like (not shown) by which it is mounted upon a desired support, in this instance the rearward portion of the support base 14, in particular the mounting apertures 214 thereof. The preferred quiver 28 is thus made to be quickly-detachable from its mount, and thus from the bow itself, by means of a quick-release lever 60, which in effect unlatches the quiver from its support bracket and allows essentially instant removal of the quiver from the bracket, which have a cooperative tongue-and-groove type of engagement structure.

As already pointed out, the structure by which the mounting member 18 is movably carried upon the base support member 14 permits both relative adjustment (i.e., changes in relative position) as well as outright separation and removal of the mounting member from the base support. Thus, by employing two or more of the mounting members 18, the archer may employe interchangeable bow sights or other such archery accessories, and may also rapidly and easily remove the bow sight from the bow where that is desired, as for example when placing the bow in its carrying case. Of course, the very rapid and easy adjustability of the apparatus lends itself well to the use of a wide variety of different bow sights, at least some of which may require or at least lend themselves to changes in relative position with respect to the bow in order to accommodate differing shooting conditions. Thus, in accordance with the invention, a bow sight-adjustment apparatus is provided as well as a demountable and interchangeable sight-mounting and/or accessory-mounting apparatus.

Figure 12:
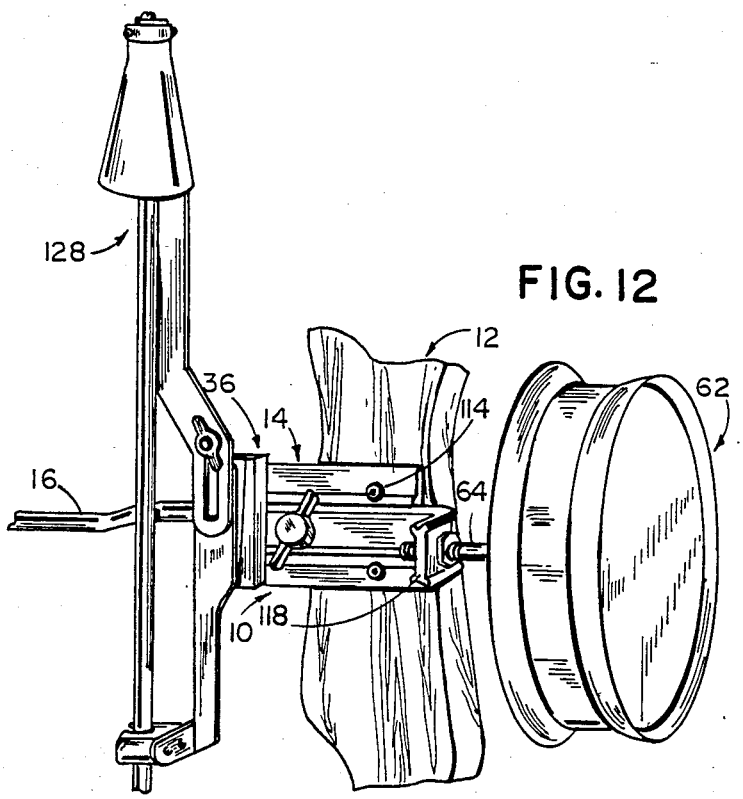
FIG. 12 is a fragmentary perspective view generally similar to FIG. 1 but showing the mounting apparatus of the invention with a modified form of mounting member carrying a bow reel.

With respect to the interchangeability of archery accessories which are made bow-mountable by the present invention, reference is made to FIG. 12, depicting a bow-fishing reel 62, which is mounted by the apparatus in accordance with the invention. More particularly, as shown in FIG. 11, the mounting apparatus 10 comprises the same base 14 as described above but a somewhat different form of mounting member 11 is used rather than the mounting member 18 previously described. That is, the fishing reel 62 may be deemed to be a conventional type of apparatus known for this general purpose, and comprising in effect a drum-like spool from which fishing line or the like may rapidly unreel after having been wound thereupon, typically by a simple manual procedure. Accordingly, it may be appreciated that such an apparatus should face toward the direction in which the arrow is to be shot from the bow, so that the line may unreel smoothly from the spool. Accordingly, the reel 62 has a rearwardly-projecting mounting stud 64 which is received within an appropriate aperture in the mounting member 118, such aperture either being threaded itself or an appropriate mechanical fastener (e.g., a nut) threaded onto the mounting stud 64 from the rear side of the mounting bracket. In accordance with this structural arrangement, the mounting bracket 118 may simply comprise a right-angled section of the support member or slide 40, having the same angular faces 42, 44 as discussed above which are receivable within the guideway provided by the guiderails 38 carried by the base 14. In the same manner, the mounting bracket 118 has at least one (or more) tapped apertures therein for receiving a threaded adjustment stud 46 carried with an attached adjustment knob 20 or 120, whereby the position of the reel 62 may be adjusted to a desired placement and the reel secured firmly in place at that position by tightening the adjustment knob. Of course, it will be understood that other specific forms of alternate mounting members 18, 118 may be utilized in accordance with the invention to accomplish particular purposes, the primary point being that interchangeability is maintained for such widely-diverse archery accessories as bow sights and fishing reels, merely to name two specific examples. At the same time, of course, adjustability is also provided, along with interchangeability.

In other respects, the mounting apparatus 10 as shown in FIG. 12 may be considered the same as that shown and described above, although it will be noted that a different form of archery quiver 128 is depicted in FIG. 12. This novel single-arrow type of bow-mounted quiver, is the subject of my co-pending application Ser. No. 925,558 filed Oct. 31, 1986. For purposes of the present disclosure, it may be assumed that the mounting structure associated with the novel quiver 128 is substantially the same as, or similar to, that described above, utilizing a quick-disconnect mounting bracket 36 as described hereinabove.

It is to be understood that the above detailed description is merely that of one exemplary preferred embodiment of the invention, and that numerous changes, alterations and variations may be made without departing from the underlying concepts and broader aspects of the invention as set forth in the appended claims, which are to be interpreted in accordance with the established principles of patent law, including the doctrine of equivalents.

The embodiments of the invention in which an exclusive property or privilege is claimed ar defined as follows:

1. Accessory-mounting apparatus for archery bows, comprising in combination: a support base, and means for attaching said base to an archery bow in a fixed and generally permanent manner; a primary archery-accessory mounting member and means for adjustably carrying such member upon said support base, said means including position-fixing apparatus for securing the mounting member in a preselected position with respect to said support base and generally forwardly of a bow upon which such base is attached; said primary accessory-mounting member including an accessory-support and mounting portion comprising a forwardly-projecting element having a surface adapted to cooperatively receive the standardized mount for a standard archery bow sight, said surface carrying a predetermined array of mechanical fastener elements arranged in a portion complementary to that of the standardized mounting elements provided upon said standard archery bow sight mount; and at least one secondary archery-accessory-mounting member carried on said support base in mutually-spaced position with respect to said primary accessory-mounting member and positioned rearwardly of said bow, said secondary accessory-mounting member including means for attachment thereto of a desired additional archery accessory device, whereby at least two different archery accessories may be securely mounted upon and carried by the same archery bow by use of a single mounting attachment thereto, and at least one such accessory is a standardized archery bow sight haing a standardized mount and said bow sight is rendered movably adjustable in position with respect to the bow.

2. Apparatus for archery bows as recited in claim 1, and further including a cable-guard arm carried by said support base and projecting therefrom toward the archer, said arm overlying at least portions of the bowstring mounted on said archery bow.

3. Apparatus for archery bows as recited in claim 2, wherein said projecting element of said accessory-support and mounting portion comprises a flange-like member having a generally flat face and a pair of mutually-spaced screw-receiving portions positioned so as to be complementary to the standardized mounting screw locations of conventional bow sights having "flat-type" mounting brackets.

4. Apparatus for archery bows as recited in claim 1, wherein said secondary archery-accessory-mounting member comprises means for mounting an arrow quiver upon said support base.

5. Apparatus for archery bows as recited in claim 4, wherein said support base and arrow quiver-mounting means have a structure whose size and proportions locate said quiver generally centrally of the bow limbs and generally adjacent a bowstring strung upon said limbs.

6. Apparatus for archery bows as recited in claim 4, wherein said means for mounting an arrow quiver includes a mounting bracket having manually-actuable quick-disconnect means for releasably carrying a quiver upon such bracket and thus releasably carrying such quiver upon the bow.

7. Apparatus for archery bows as recited in claim 4, and further including a cable-guard arm carried by said support base and projecting therefrom toward the archer, said arm overlying at least portions of the bowstring mounted on said archery bow.

8. Apparatus for archery bows as recited in claim 7, and including means for releasably mounting said cable-guard arm upon said support base, such that said cable-guard arm may be removed from said apparatus when desired.

9. Apparatus for archery bows as recited in claim 1, and further including an alternate accessory-mounting member substitutable for said primary such mounting member, said alternate accessory-mounting member having carying means operably associated therewith for interchangeable mounting upon said support base with said means for movably carrying said primary accessory-mounting member upon said suupport base, and said alternate accessory-mounting member further having an accessory support and mounting portion having a second and different array of mechanical fastener elements arranged for cooperatively receiving the mounting apparatus of an alternate and different archery accessory.

10. Apparatus for archery bows as recited in claim 9, wherein said alternate accessory-mounting member comprises a mounting bracket having means for securing a bow-fishing reel to said bracket.

11. Apparatus for archery bows as recited in claim 10, and including a bow-fishing reel mounted upon said bracket.

12. Apparatus for archery bows as recited in claim 1, and including guiderail means on one of said support base and said primary archery-accessory-mounting member and a slide member attached to the other thereof, said guiderail means defining a recess sized and configured to slidably receive said slide member, whereby said support base and said primary mounting member are relatively movably adjustable with respect to one another.

13. Apparatus for archery bows as recited in claim 12, and including means for holding said slide member in selected positions of adjustment with respect to said guiderail means.

14. Apparatus for archery bows as recited in claim 13, and including a cable-guard arm carried by said support base and projecting therefrom toward the archer, said arm overlying at least portions of the bowstring mounted on said archery bow; and wherein said secondary archery-accessory-mounting member comprises means for mounting an arrow quiver upon said support base.

* * * * *